US011618535B1

(12) United States Patent
Williams et al.

(10) Patent No.: US 11,618,535 B1
(45) Date of Patent: Apr. 4, 2023

(54) MOTION DAMPING SYSTEM FOR TANK OF LIQUID

(71) Applicant: United States of America as represented by the Administrator of NASA, Washington, DC (US)

(72) Inventors: Rebecca L. Williams, Huntsville, AL (US); Robert E. Berry, Madison, AL (US); Frederick Scott Gant, Huntsville, AL (US); Jeffrey L. Lindner, Huntsville, AL (US); John S. Townsend, Union Grove, AL (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 17/936,064

(22) Filed: Sep. 28, 2022

(51) Int. Cl.
*B63B 39/03* (2006.01)
*B63B 43/06* (2006.01)

(52) U.S. Cl.
CPC ..... *B63B 39/03* (2013.01); *B63B 43/06* (2013.01)

(58) Field of Classification Search
CPC ..... B63B 39/03; B63B 43/06
See application file for complete search history.

(56) References Cited

U.S. PATENT DOCUMENTS 4,167,147 A * 9/1979 Bergman ..... B63B 39/03 114/265
4,176,614 A * 12/1979 Goss ..... B63B 39/03 405/200
4,864,958 A * 9/1989 Belinsky ..... B63B 13/00 114/265
6,910,438 B2 * 6/2005 Leverette ..... B63B 39/005 114/265
8,215,253 B2 * 7/2012 Kim ..... F16F 7/10 114/264
8,387,550 B2 * 3/2013 Mansour ..... B63B 35/44 114/265
10,549,818 B2 * 2/2020 Merchant ..... B63B 35/4413
(Continued)

FOREIGN PATENT DOCUMENTS

WO WO 2020/093037 A2 5/2020
WO WO-2020093037 A2 * 5/2020 ..... B63B 35/44

*Primary Examiner* — S. Joseph Morano
*Assistant Examiner* — Jovon E Hayes
(74) *Attorney, Agent, or Firm* — Jerry L. Seemann; Trenton J. Roche

(57) ABSTRACT

A motion damping system includes a tank compartmentalized to have a first compartment having a first opening, a second compartment having a second opening, and a third compartment disposed between the first and second compartments. The third compartment is in fluid communication with the first and second openings. A first piston is movably sealed within the first compartment and is in fluid communication with its first opening. A second piston is movably sealed within the second compartment and is in fluid communication with its second opening. A liquid fills the third compartment, a portion of the first compartment up to the first piston, and a portion of the second compartment up to the second piston. A coupling fixedly attached to the first and second pistons moves in correspondence with the first and second pistons. Motion damper(s) coupled to the coupling resist movements of the first and second pistons.

21 Claims, 3 Drawing Sheets

(56) References Cited

U.S. PATENT DOCUMENTS

| | | | | |
|---|---|---|---|---|
| 11,279,452 | B2 * | 3/2022 | Allen | B63B 39/02 |
| 2004/0216657 | A1 * | 11/2004 | Leverette | B63B 39/005<br>114/265 |

* cited by examiner

MOTION DAMPING SYSTEM FOR TANK OF LIQUID

ORIGIN OF THE INVENTION

The invention described herein was made in the performance of work under a NASA contract and by an employee of the United States Government and is subject to the provisions of Public Law 96-517 (35 U.S.C. § 202) and may be manufactured and used by or for the Government for governmental purposes without the payment of any royalties thereon or therefore. In accordance with 35 U.S.C. § 202, the contractor elected to retain title.

BACKGROUND OF THE INVENTION

Field of the Invention

This invention relates to damping motion of liquids. More specifically, the invention is a system for damping the motion of a liquid contained within a tank such as the motion of ballast water in the ballast tank(s) of a floating maritime structure.

Description of the Related Art

A variety of maritime structures floating at the surface of a body of water (e.g., ships, oil tankers, barges, wind turbines, etc.) are subject to wave and/or wind excitation that can cause a structure to experience pitch, roll, and/or heave motions that can limit the performance of the structure. In addition, such externally-induced motion of maritime structures often reduces the lifespan thereof owing to structural degradation brought on by unmitigated wave-induced motion.

Performance and structural degradation of maritime structures are greatly exacerbated in the face of high-amplitude wave excitation. There are multiple families of existing tuned mass dampers and tuned vibration absorbers that are used for a variety of motion-damping applications across multiple industries. However, conventional motion dampers are not capable of damping the range of motion amplitudes and motion frequencies experienced by maritime structures in open water environments.

SUMMARY OF THE INVENTION

Accordingly, it is an object of the present invention to provide motion damping system for a tank of liquid.

Another object of the present invention is to provide motion damping system for installation on floating structures having ballast tanks.

Other objects and advantages of the present invention will become more obvious hereinafter in the specification and drawings.

In accordance with the present invention, a system is provided for damping motion of a liquid contained within a tank. The tank is compartmentalized to have a first compartment having a first opening, a second compartment having a second opening, and a third compartment disposed between the first compartment and second compartment. The third compartment is in fluid communication with the first opening and second opening. A first piston is movably sealed within the first compartment and is in fluid communication with the first opening thereof. A second piston is movably sealed within the second compartment and is in fluid communication with the second opening thereof. The tank has a liquid filling the third compartment, a portion of the first compartment up to the first piston, and a portion of the second compartment up to the second piston. A coupling is fixedly attached to the first piston and second piston where the coupling moves in correspondence with movements of the first piston and second piston. At least one motion damper is coupled to the coupling to resist movements of the first piston and second piston.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

The present invention is a novel system for damping the motion of liquid in a tank. In general, the goal is to reduce or damp motion of a tank's liquid in an effort to reduce or damp motion of the tank as well as any primary structure that supports the tank. While the present invention can be adapted for use with primary structures that are land-based or water-based, the description to follow will be directed to primary structures that float on the surface of a body of water. The floating structures can be any fixed or movable "platform" configured for floating at the surface of a body of water, e.g., a river, lake, bay, ocean, etc. Examples of such floating structures include, but are not limited to, ships, oil tankers, barges, and wind turbines. The tank used by the present invention can be an integral portion of a primary structure (e.g., a floating structure's ballast tanks), or can be a tank configured as described herein and coupled to a primary structure for the sole function of providing motion damping for the primary structure without departing from the scope of the present invention.

In general, most of the above-mentioned floating structures include ballast tanks partially or completely filled with a ballast liquid (e.g., water) to control the structure's buoyancy as is well understood in the art. However, as a floating structure is subjected to externally-induced motion, the ballast water in its ballast tanks is excited to motion that can continue to impact the floating structure even after the source (e.g., waves, wind, etc.) of the externally-induced motion subsides. As will be explained further below, the present invention provides a system that leverages a floating structure's existing ballast tanks and the ballast water therein to modify (e.g., damp) the motion of ballast water as a means change the motion dynamics of the primary/floating structure that supports the ballast tank.

Figure 1:
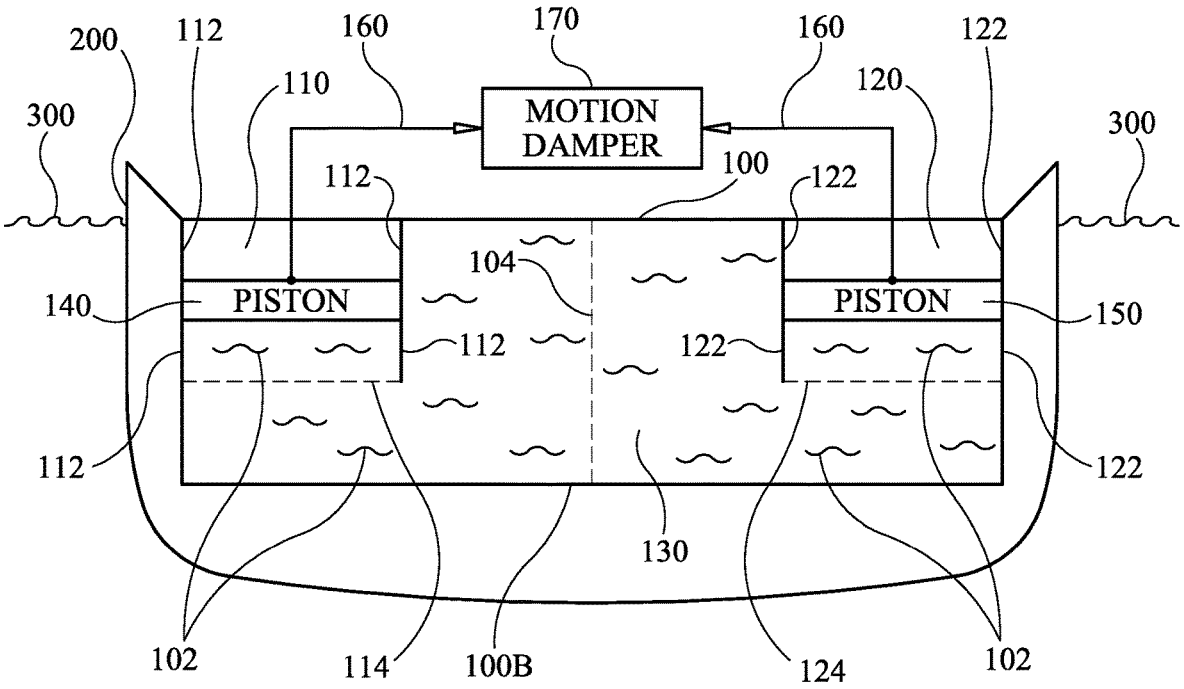
FIG. 1 is a schematic view of a motion damping system for a tank of liquid in accordance with an embodiment of the present invention.

Referring now to the drawings and more particularly to FIG. 1, a schematic view of a tank 100 having a liquid 102 (also referred to hereinafter as "tank liquid 102") therein is illustrated. It will be assumed that tank 100 is coupled to a supporting (primary) structure 200. For example, structure 200 can be a floating maritime structure designed to float at the surface of a body of water 300. Accordingly, tank 100 can be a ballast tank with tank liquid 102 being ballast water. The center of tank 100 is indicated by dashed line 104. It is to be understood that center 104 of tank 100 need not be the center of structure 200.

In accordance with the present invention, tank 100 is configured to have three compartments defined therein. A first compartment 110 of tank 100 is located on one side of tank 100, and a second compartment 120 of tank 100 is located on the other side of tank 100. That is, compartments 110 and 120 are disposed on opposite sides of the tank's center 104. A third compartment of tank 100 is disposed between compartments 110 and 120. Compartments 110 and 120 have rigid walls 112 and 122, respectively. Walls 112 and 122 can be part of tank 100, or can be separately constructed and then attached to tank 100, without departing from the scope of the present invention. Compartments 110 and 120 have an opening 114 and 124, respectively. Openings 114 and 124 face the bottom 100B of tank 100 in the illustrated embodiment. Third compartment 130 is in fluid communication with each of openings 114 and 124 such that tank liquid 102 can flow through openings 114 and 124.

A first piston 140 is sealed within compartment 110 such that it can move one-dimensionally along and within compartment 110. A variety of movably sealed piston structures can be used for piston 140 without departing from the scope of the present invention. For example, one type of movably sealed piston can be constructed using a rigid plate and a rolling diaphragm. Briefly, a rolling diaphragm could be disposed between the periphery of a rigid plate and the inside of walls 112. In some embodiments, piston 104 could be realized by a bellows movably sealed to the inside of walls 112. In still other embodiments, piston 140 could be realized by a diaphragm or a simple piston floating on tank liquid 102. Regardless of its construction, one face of piston 140 is in fluid communication with opening 114 of compartment 110.

In a similar fashion, second piston 150 is sealed within compartment 120 such that it can move one-dimensionally along and within compartment 120. A variety of movably sealed piston structures can also be used for piston 150 (i.e., as described for piston 140) without departing from the scope of the present invention. Regardless of its construction, one face of piston 150 is in fluid communication with opening 124 of compartment 120.

Pistons 140 and 150 are coupled to one another such that movement of one piston in its compartment results in corresponding movement of the other piston in its compartment. That is, in the illustrated embodiment, upward/downward movement of piston 140 results in corresponding downward/upward movement of piston 150. In general, pistons 140 and 150 are joined by a coupling structure 160 and a motion damper 170. Coupling structure 160 is any element and/or mechanism that supports the above-described corresponding movements of pistons 140 and 150. Motion damper 170 is any element and/or mechanism that resists or damps the motion of coupling structure 160.

In operation, tank liquid 102 (e.g., ballast water) fills third compartment 130 and the portions of first compartment 110 and second compartment 120 via their respective openings 114 and 124 up to their respective pistons 140 and 150. When floating structure is externally excited into motion (e.g., via wind/and/or waves), tank liquid 102 exerts pressure on at least one of pistons 140 and 150. For example, when one piston moves up, the other moves down resulting in a horizontal back and forth flow of tank liquid 102. Coupling structure 160 ensures that the two pistons move in correspondence. Motion damper 170 resists the head pressure of tank liquid 102 acting on the pistons by damping the motion of coupling structure 160 in an effort to keep the pistons in position in their respective compartments.

The damped motion of tank liquid 102 translates into the damping of motion of tank 100. Since tank 100 is coupled to floating structure 200, the damped motion of tank 100 acts to change/damp the motion dynamics of floating structure 200.

Figure 2:
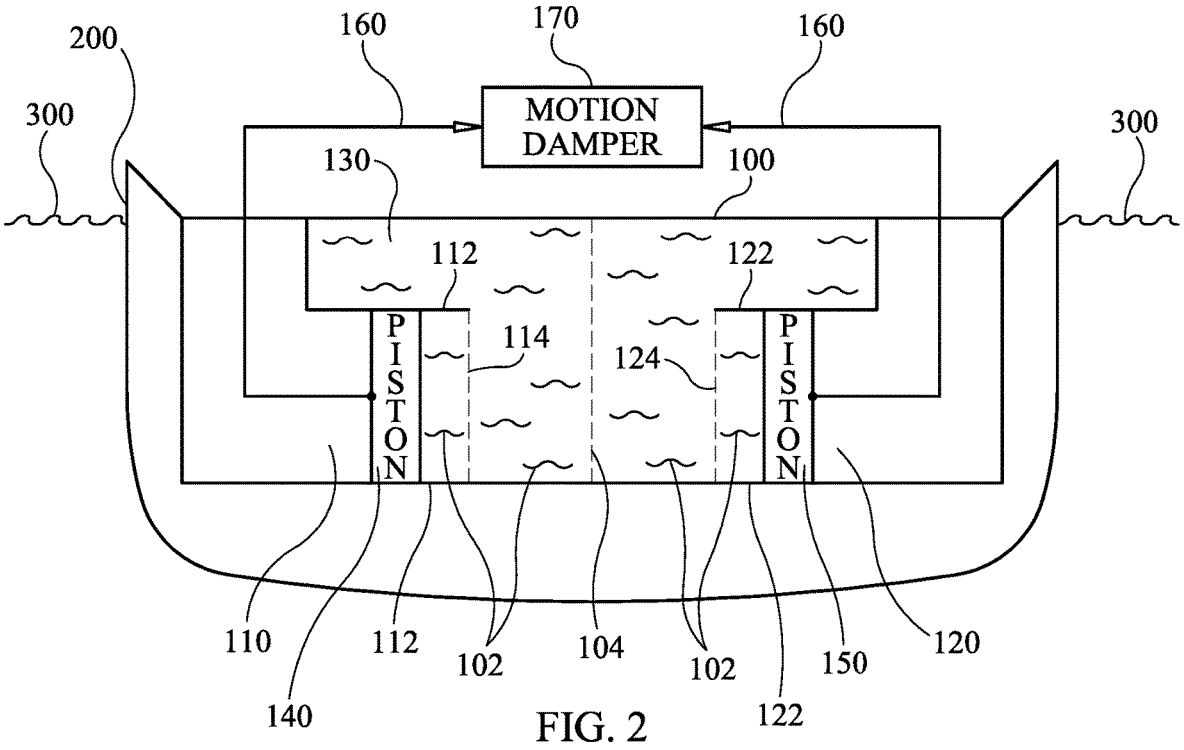
FIG. 2 is an isolated schematic view of a motion damping system for a tank of liquid in accordance with another embodiment of the present invention.

Referring now to FIG. 2, another embodiment of the present invention is illustrated in which first compartment 110 and second compartment 120 are still located on opposing sides of the center 104 of tank 100. However, in this embodiment, first compartment 110 and second compartment 120 are oriented in tank 100 such that their respective openings 114 and 124 face one another. The operational principles of this embodiment are the same as those described above for the FIG. 1 embodiment.

Figure 3:
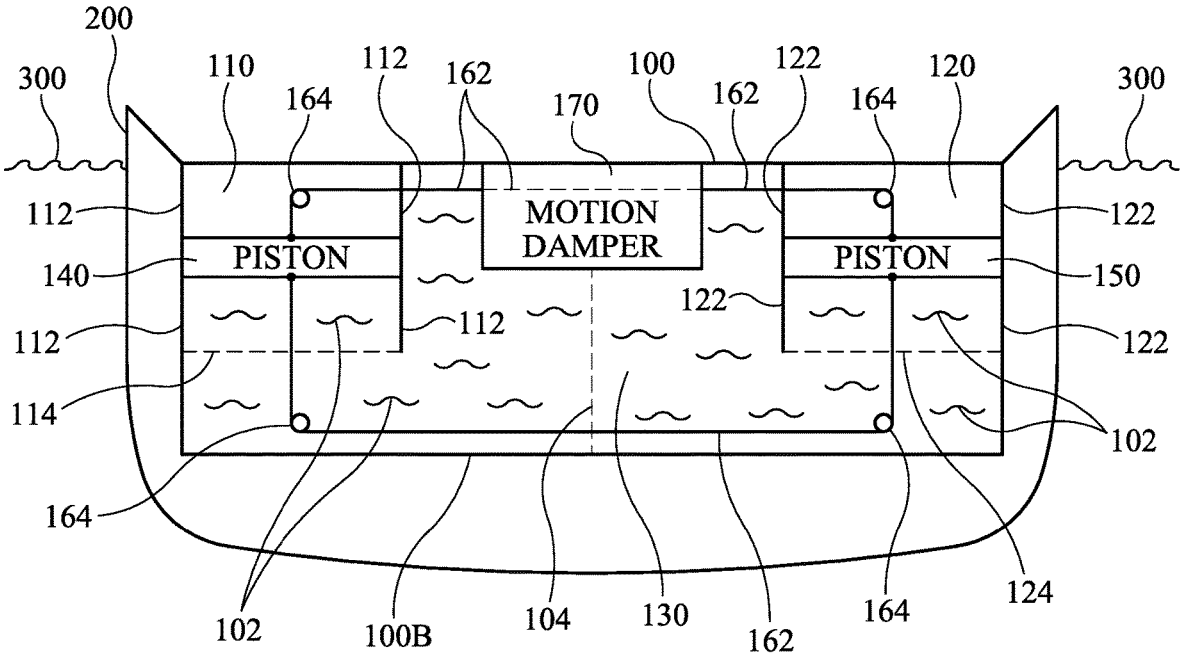
FIG. 3 is a schematic view of a motion damping system for a tank of liquid as shown in FIG. 1 and configured with an endless tension element in accordance with an embodiment of the present invention.
Figure 4:
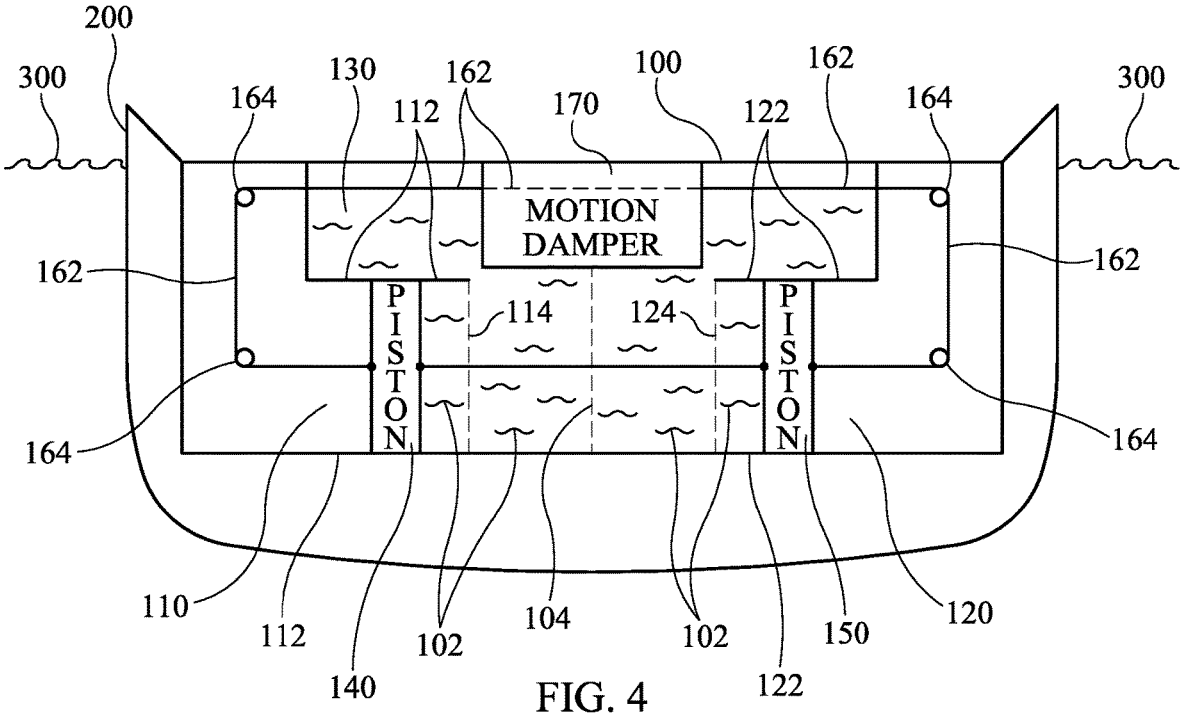
FIG. 4 is a schematic view of a motion damping system for a tank of liquid as shown in FIG. 2 and configured with an endless tension element in accordance with another embodiment of the present invention.

As mentioned above, the realization of coupling structure 160 can be achieved in a variety of ways without departing from the scope of the present invention. For example and as shown in FIG. 3, the piston coupling structure for the FIG. 1 embodiment can be realized by an endless flexible element 162 (e.g., cable, belt, chain, etc.) fixedly attached to pistons 140 and 150. Flexible element 162 is placed in tension and is routed into and/or around tank 100 using a plurality of guides 164 (e.g., sheaves, wheels, etc.). Flexible element 162 can be passed through motion damper 170 where the above-described resistance force to movement of flexible element 162 is applied thereto. For this embodiment, motion damper 170 could be realized by, for example, by any device/system that provides a linear or non-linear resistance force to flexible element 162. The above-described piston coupling structure could also be used to realize the FIG. 2 embodiment of the present invention as illustrated in FIG. 4.

Figure 5:
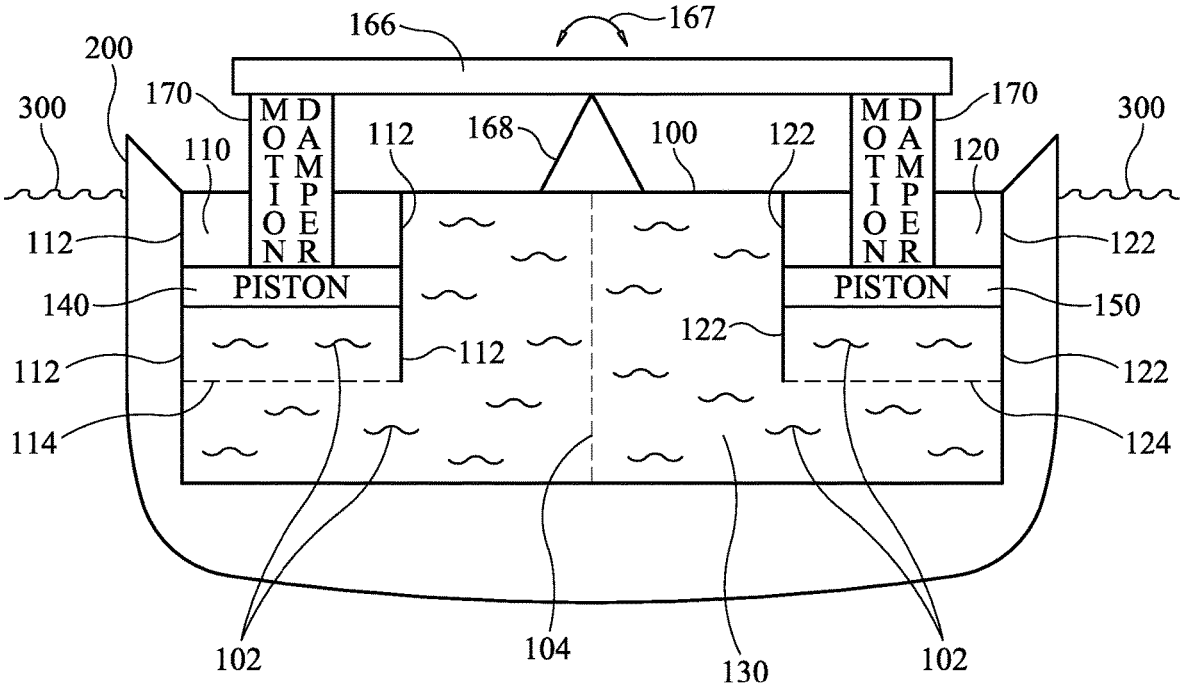
FIG. 5 is a schematic view of a motion damping system for a tank of liquid as shown in FIG. 1 and configured with a rigid lever in accordance with another embodiment of the present invention.

In some embodiments of the present invention, a rigid lever can be used to couple the motion damping system's two pistons. For example and as illustrated in FIG. 5, the earlier-described FIG. 1 embodiment has its piston coupling structure realized by a rigid lever 166 capable of pivoting motion (as indicated by two-headed arrow 167) about a fixed fulcrum 168. One end of lever 166 is coupled to piston 140 through a motion damper 170. The other end of lever 166 is coupled to piston 150 through a second motion damper 170. One or more additional motion dampers (not shown) could be positioned along the length of lever 166. In this embodiment, motion damper 170 can be realized, for example, by any device/system that resists pivoting motion 167. The operational principles of this embodiment are the same as described earlier herein.

The advantages of the present invention are numerous. The motion damping system of the present invention does not need to be tuned to any particular frequency to be effective, although the system can be tuned by piston sizing, liquid height (or length) in the compartments, the addition of springs, or any other addition/modification that enhances system performance in a selected frequency range. The present invention can be incorporated into new designs/constructions, but can also be added to existing structures. Unlike conventional Tuned Liquid Dampers, the present invention does not rely on viscous losses from the liquid (water) motion to work. Furthermore, slosh is not relevant as is the case with conventional slosh dampers. Since the tank liquid cannot slosh, the tank liquid is better controlled and acts in a more predictable manner. The present invention is readily scaled to different sizes depending on the application, and it can be implemented on the surface of a structure (e.g., the deck of a ship) or within the primary structure (e.g., existing ballast tanks of floating structure). The present invention can be used in a variety of maritime applications where mitigation of heave, pitch, and roll is needed. However, it is to be understood that the present invention can be used in any maritime or land-based structures that currently rely on Tuned Liquid Dampers or Tuned Liquid Column Dampers to mitigate unwanted dynamics. Still further, the present invention can be adapted for use in the land-based vehicles (e.g., trucks or trains having liquid-carrying tanks) where fluid slosh can have an extremely detrimental effect on the ride of the vehicle.

Although the invention has been described relative to specific embodiments thereof, there are numerous variations and modifications that will be readily apparent to those skilled in the art in light of the above teachings. For example, the pistons could be coupled to one another by means of a fluid (e.g., air) to provide the needed motion damping there between as described herein. It is therefore to be understood that, within the scope of the appended claims, the invention may be practiced other than as specifically described.

What is claimed as new and desired to be secured by Letters Patent of the United States is:

1. A system for damping motion of a liquid contained within a tank, comprising:

a tank compartmentalized to have a first compartment having a first opening, a second compartment having a second opening, and a third compartment disposed between said first compartment and said second compartment, said third compartment in fluid communication with said first opening and said second opening;

a first piston movably sealed within said first compartment and in fluid communication with said first opening;

a second piston movably sealed within said second compartment and in fluid communication with said second opening;

said tank adapted to have a liquid fill said third compartment, a portion of said first compartment up to said first piston, and a portion of said second compartment up to said second piston;

a coupling fixedly attached to said first piston and said second piston, wherein said coupling moves in correspondence with movements of said first piston and said second piston; and at least one motion damper coupled to said coupling for resisting said movements of said first piston and said second piston.

2. A system as in claim 1, wherein said coupling comprises a flexible element in tension.

3. A system as in claim 1, wherein said coupling comprises a rigid lever.

4. A system as in claim 1, wherein said tank has a bottom, and wherein said first opening and said second opening face said bottom.

5. A system as in claim 1, wherein said first opening faces said second opening.

6. A system as in claim 1, wherein said tank has a center, and wherein said first compartment and said second compartment are disposed on opposite sides of said center.

7. A system as in claim 2, wherein said flexible element passes through said at least one motion damper.

8. A system as in claim 1, wherein said tank is adapted to be coupled to a maritime structure that floats on a body of water.

9. A system as in claim 1, wherein said tank comprises a ballast tank of a maritime structure that floats on a body of water.

10. A system for damping motion of ballast water contained within a ballast tank, comprising:

a ballast tank compartmentalized to have a first compartment having a first opening disposed at a first side of said ballast tank, a second compartment having a second opening disposed at a second side of said ballast tank, and a third compartment disposed between said first compartment and said second compartment, said third compartment in fluid communication with said first opening and said second opening;

a first piston movably sealed within said first compartment and in fluid communication with said first opening;

a second piston movably sealed within said second compartment and in fluid communication with said second opening;

ballast water filling said third compartment, a portion of said first compartment up to said first piston, and a portion of said second compartment up to said second piston;

a coupling fixedly attached to said first piston and said second piston, wherein said coupling moves in correspondence with movements of said first piston and said second piston; and at least one motion damper coupled to said coupling for resisting said movements of said first piston and said second piston.

11. A system as in claim 10, wherein said coupling comprises a flexible element in tension.

12. A system as in claim 10, wherein said coupling comprises a rigid lever.

13. A system as in claim 10, wherein said ballast tank has a bottom, and wherein said first opening and said second opening face said bottom.

14. A system as in claim 10, wherein said first opening faces said second opening.

15. A system as in claim 10, wherein said ballast tank has a center, and wherein said first compartment and said second compartment are disposed on opposite sides of said center.

16. A system as in claim 11, wherein said flexible element passes through said at least one motion damper.

17. A system for damping motion of ballast water contained within a ballast tank, comprising:

a ballast tank compartmentalized to have a first compartment having a first opening disposed at a first side of said ballast tank, a second compartment having a second opening disposed at a second side of said ballast tank, and a third compartment disposed between said first compartment and said second compartment, said third compartment in fluid communication with said first opening and said second opening;

a first piston movably sealed within said first compartment and in fluid communication with said first opening;

a second piston movably sealed within said second compartment and in fluid communication with said second opening;

ballast water filling said third compartment, a portion of said first compartment up to said first piston, and a portion of said second compartment up to said second piston;

an endless tension element fixedly attached to said first piston and said second piston, wherein said endless tension element moves in correspondence with movements of said first piston and said second piston; and at least one motion damper coupled to said endless tension element for resisting said movements of said first piston and said second piston.

18. A system as in claim 17, wherein said ballast tank has a bottom, and wherein said first opening and said second opening face said bottom.

19. A system as in claim 17, wherein said first opening faces said second opening.

20. A system as in claim 17, wherein said ballast tank has a center, and wherein said first compartment and said second compartment are disposed on opposite sides of said center.

21. A system as in claim 17, wherein said endless tension element passes through said at least one motion damper.

* * * * *